US008172215B2

(12) United States Patent
Ichimura

(10) Patent No.: US 8,172,215 B2
(45) Date of Patent: May 8, 2012

(54) SHEET STACKING APPARATUS

(75) Inventor: Shoichi Ichimura, Ibaraki (JP)

(73) Assignee: Komori Corporation, Tokyo (JP)

( * ) Notice: Subject to any disclaimer, the term of this patent is extended or adjusted under 35 U.S.C. 154(b) by 117 days.

(21) Appl. No.: 12/765,684

(22) Filed: Apr. 22, 2010

(65) Prior Publication Data

US 2010/0270737 A1 Oct. 28, 2010

(30) Foreign Application Priority Data

Apr. 23, 2009 (JP) ..... 2009-105177

(51) Int. Cl.
*B65H 31/30* (2006.01)

(52) U.S. Cl. ..... 270/59; 270/58.02; 414/789.9

(58) Field of Classification Search ..... 270/58.01, 270/58.02, 58.07, 59; 414/789.9; 377/8–16; 271/155

See application file for complete search history.

(56) References Cited

U.S. PATENT DOCUMENTS 6,227,530 B1 * 5/2001 Namba et al. ..... 270/58.09
2003/0146559 A1 * 8/2003 Middelberg et al. ..... 271/9.01

FOREIGN PATENT DOCUMENTS

EP 1 876 383 A2 12/2006
WO WO 00/66938 11/2000
WO WO 2004/078626 A 9/2004

* cited by examiner

*Primary Examiner* — Leslie A Nicholson, III

(74) *Attorney, Agent, or Firm* — Blakely, Sokoloff, Taylor & Zafman

(57) ABSTRACT

In a sheet stacking apparatus, a sheet stacking unit stacks sheets conveyed by a sheet conveyance device. Three sheet extraction portions allow to selectively extract the sheets stacked on the sheet stacking unit from one of three directions including the downstream side of the sheet conveyance direction and two directions perpendicular to the sheet conveyance direction. A plurality of first detection sensors are provided in at least two of the three sheet extraction portions to detect an object that enters the sheet stacking unit. A second detection sensor detects the moving direction of the sheets stacked on the sheet stacking unit. A control device stops the operation of the sheet conveyance device when the first detection sensor detects the object, and disables the detection operation of the first detection sensor corresponding to the moving direction of the sheets when the second detection sensor detects the moving direction of the sheets.

11 Claims, 19 Drawing Sheets

SHEET STACKING APPARATUS

BACKGROUND OF THE INVENTION

The present invention relates to a sheet stacking apparatus which stacks, on a pallet, sheets conveyed from a printing unit, coating unit, or the like, and extracts a predetermined number of stacked sheets from the apparatus.

A sheet stacking apparatus of this type includes sensors for detecting that the operator has entered, during an operation, an extraction portion to be used to extract sheets from the apparatus. If the operator has entered from the extraction portion into the apparatus during the operation, the sensors detect it to stop the operation of the apparatus (printing press). This allows to prevent the operator from erroneously entering the apparatus during the operation. On the other hand, to extract a predetermined number of stacked sheets from the apparatus via the extraction portion, the operator operates a manual button to disable the detection operation of the sensors.

The conventional sheet stacking apparatus has three extraction portions for various kinds of operations including extraction of a predetermined number of stacked paper sheets from a sheet stacking unit that stacks paper sheets conveyed from a printing press. Each extraction portion has a safety device for the delivery apparatus, which includes first to third detection sensors for detecting entering of the operator or the like, and a detection cancel device for disabling the detection operation of the detection sensors (patent reference 1).

[Patent reference 1] WO 2004/078626A1

The above-described detection cancel device includes a detection cancel key A configured to cancel a first detection sensor of the upper part for sampling or pile adjustment, a detection cancel key B configured to cancel a third detection sensor of the lower part when making the fork of a forklift enter the stacking unit, and a detection cancel key C configured to cancel the first to third detection sensors of the upper, middle, and lower parts when delivering stacked sheets from the stacking unit.

In the conventional sheet stacking apparatus having the above-described arrangement, to deliver stacked sheets from the stacking unit, the detection cancel key B is operated first to make the fork enter the stacking unit. After that, the detection cancel key C is operated to make the fork exit. That is, since not only the detection cancel key B but also the detection cancel key C needs to be operated, the operator finds operating the detection cancel key C cumbersome and may forget it.

SUMMARY OF THE INVENTION

It is an object of the present invention to provide a sheet stacking apparatus which improves operability in extracting sheets and also prevents any operation errors.

In order to achieve the above-described object, according to the present invention, there is provided a sheet stacking apparatus comprising a sheet stacking unit which stacks sheets conveyed by a sheet conveyance device, three sheet extraction portions which allow to selectively extract the sheets stacked on the sheet stacking unit from one of three directions including a downstream side of a sheet conveyance direction and two directions perpendicular to the sheet conveyance direction, a plurality of first detection sensors which are provided in at least two of the three sheet extraction portions to detect an object that enters the sheet stacking unit, a second detection sensor which detects a moving direction of the sheets stacked on the sheet stacking unit, and a control device which stops an operation of the sheet conveyance device when the first detection sensor detects the object, and disables a detection operation of the first detection sensor corresponding to the moving direction of the sheets when the second detection sensor detects the moving direction of the sheets.

DESCRIPTION OF THE PREFERRED EMBODIMENTS

A sheet stacking apparatus according to the first embodiment of the present invention will now be described with reference to FIGS. 1 to 11.

Figure 1:
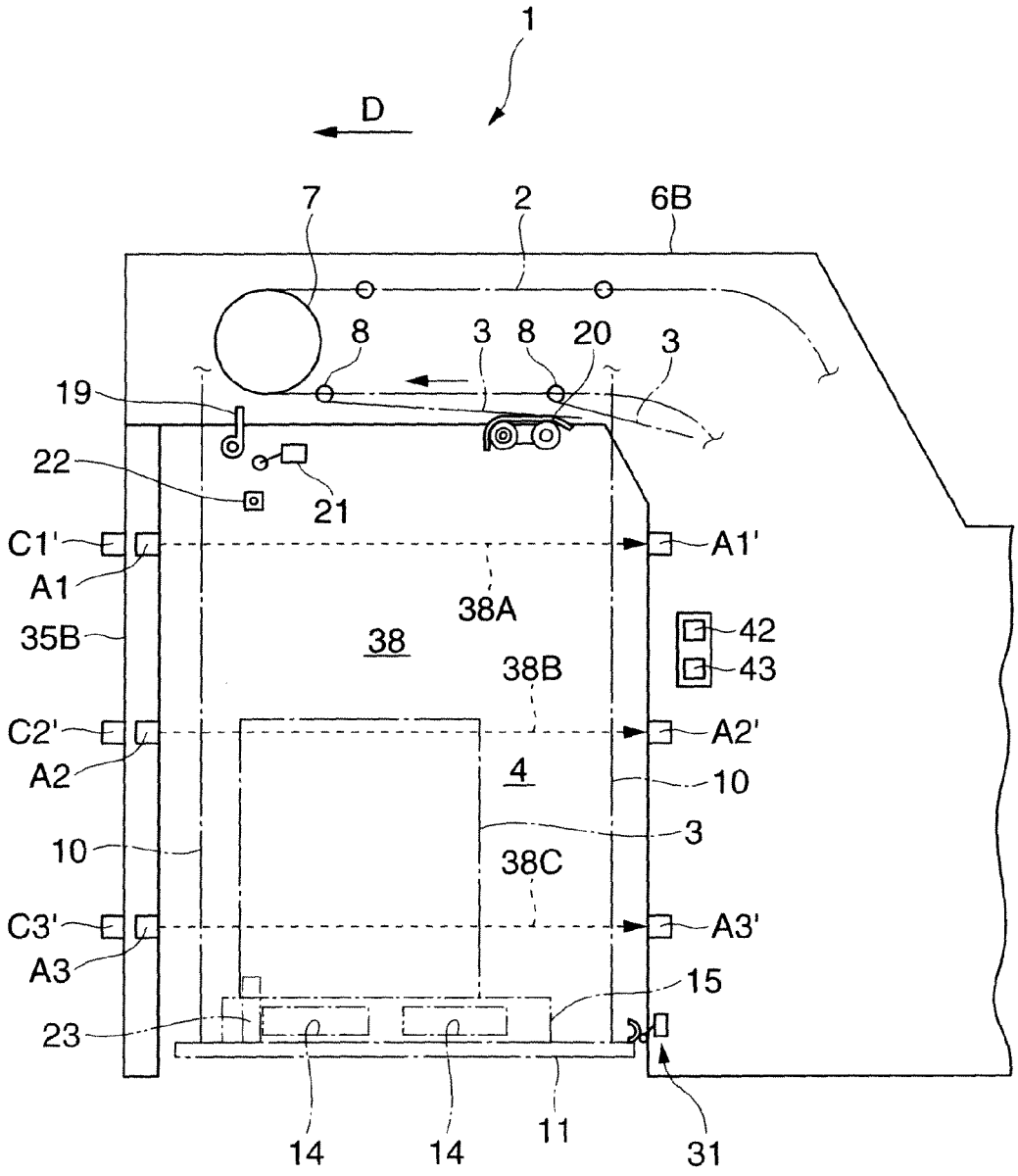
FIG. 1 is a side view of the delivery unit of a sheet-fed offset rotary printing press to which a sheet stacking apparatus according to the first embodiment of the present invention is applied.

A sheet stacking apparatus 1 shown in FIG. 1 includes a sheet stacking unit 4 which stacks, on a pallet 15, sheets 3 printed by a sheet-fed offset rotary printing press (not shown) and conveyed by delivery chains (sheet conveyance apparatus) 2. The pallet 15 with the sheets 3 stacked on it is extractable from the sheet stacking unit 4 in three horizontal directions, as will be described later. The delivery chains 2 are looped between a sprocket 7 provided around a shaft supported between a pair of delivery frames 6A and 6B of the delivery unit and a sprocket (not shown) on the printing unit side.

A plurality of gripper bars are supported between the pair of delivery chains 2 (one delivery chain 2 is not illustrated) while being spaced apart at a predetermined interval. Each of the gripper bars has a plurality of gripper units 8 that are juxtaposed and schematically illustrated in FIG. 1. Each gripper unit 8 is formed from a gripper and a gripper pad. In this arrangement, each sheet 3 printed by the printing unit, gripped by the gripper units 8, and conveyed as the delivery chains 2 run is released from the gripper units 8 on the upstream side of the sprocket 7 and drops onto the sheet stacking unit 4.

Figure 2:
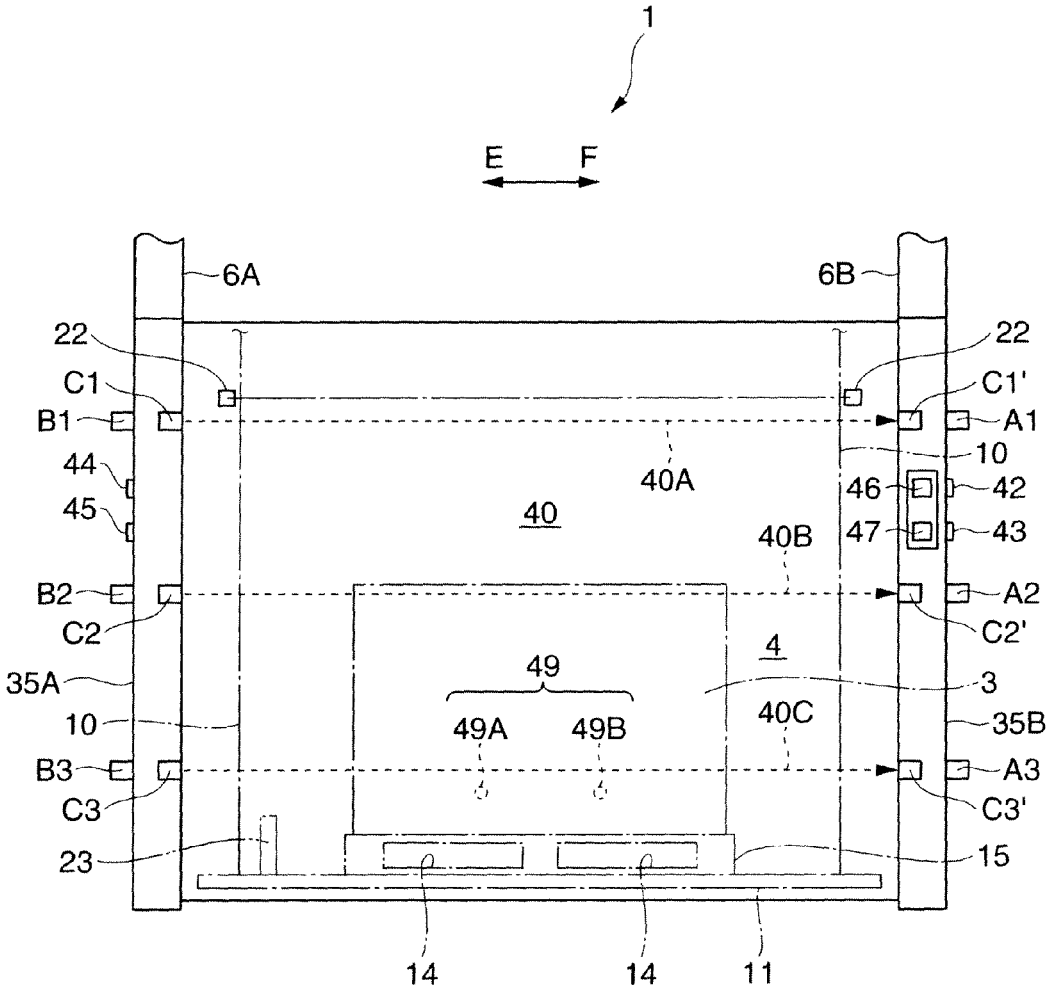
FIG. 2 is a front view of the delivery unit shown in FIG. 1.

A rectangular pile board 11 is hung at the four corners by four hoist chains 10 which move upward and downward when driving a pile board hoist motor 9 (FIG. 4) provided near the driving-side delivery frame 6A shown in FIG. 2. The pile board 11 moves upward and downward as the motor 9 rotates in the forward and reverse directions. The pallet 15 (FIG. 3) which is rectangular when viewed from the upper side, and has holes 14 for receiving a fork 13 of a forklift 12 is mounted on the pile board 11.

The sheet stacking unit 4 has, at its upper end on the front side, a sheet lay 19 that abuts against the leading edge of the dropping sheet 3 so as to align the sheet conveyance direction, as shown in FIG. 1. The sheet stacking unit 4 has, at its upper end on the rear side, a suction wheel 20 which contacts and sucks the trailing edge of the conveyed sheet 3 so as to damp the movement of the sheet 3.

The sheet stacking unit 4 has, near the sheet lay 19 on the upper side, a limit switch 21 which defines the hoisting limit of the pile board 11. When the pallet 15 mounted on the pile board 11 that is moving upward abuts against the contact piece of the limit switch 21, the motor 9 stops, and the pile board 11 stops moving upward.

A pair of noncontact sensors 22 are provided slightly on the lower side of the limit switch 21. A detection rubber member 23 stands on the upper surface of the pile board 11 in correspondence with the sensors 22. The sensors 22 and the detection rubber member 23 construct an overrun detector. More specifically, when the pile board 11 moves up to just before the limit switch 21, and the detection rubber member 23 shields the sensors 22, the motor 9 is decelerated based on the detection signal from the sensors 22.

Figure 4:
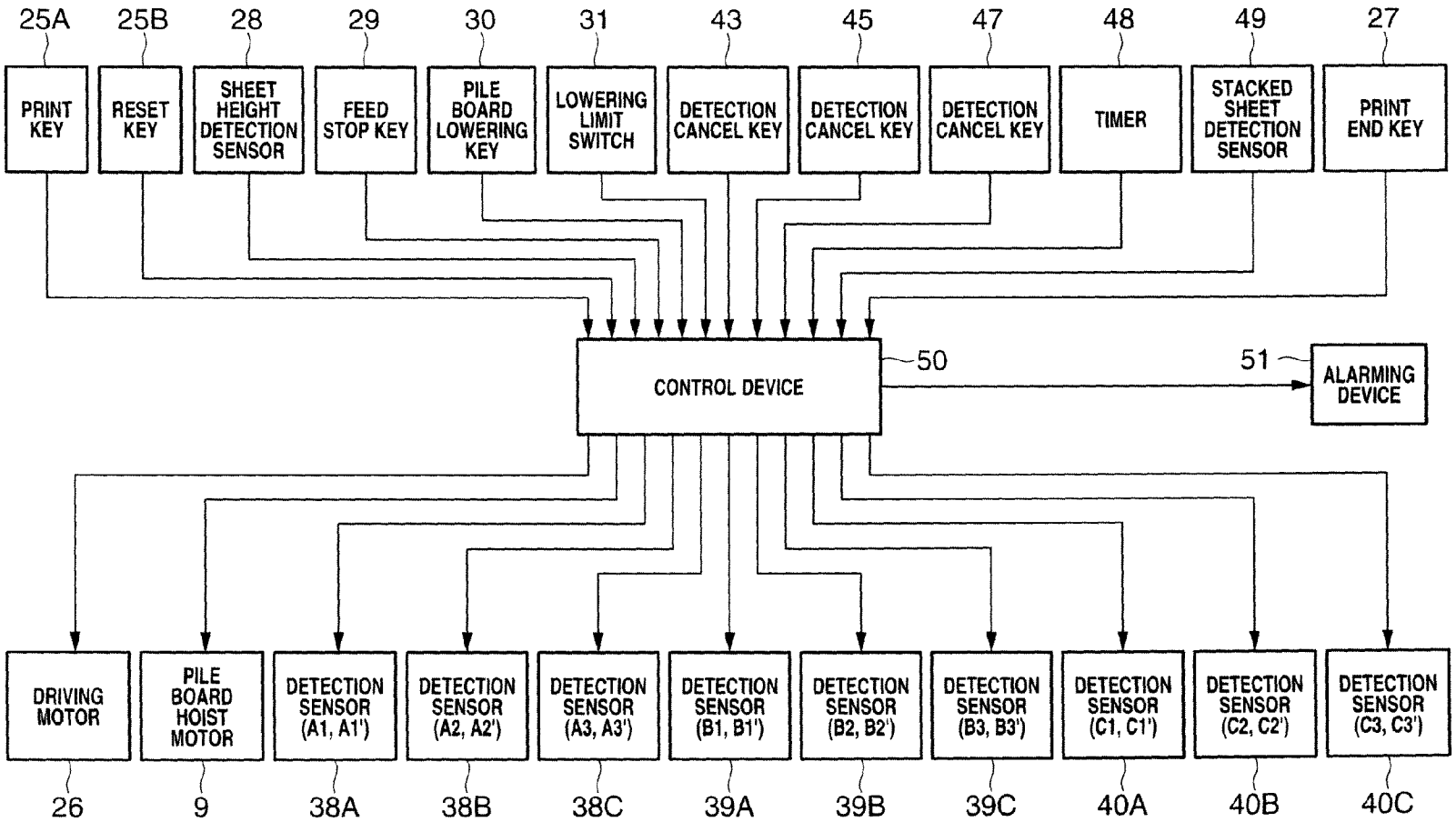
FIG. 4 is a block diagram showing the electrical arrangement of the apparatus according to the first embodiment shown in FIG. 1.

As shown in FIG. 4, the sheet stacking apparatus 1 includes a control device 50, a print key 25A which instructs the start of printing, a print end key 27 which instructs the end of printing, a sheet height detection sensor 28 which detects the height of the sheets 3 stacked on the pallet 15, a feed stop key 29 which instructs to stop an operation of supplying the sheets 3, a pile board lowering key 30 which moves the pile board 11 down by a manual operation, and a limit switch 31 which sets the lowering limit of the pile board 11. In addition to the above-described elements, the sheet stacking apparatus 1 also includes the pile board hoist motor 9 (described above), a reset key 25B, a driving motor 26, detection sensors 38A to 38C, 39A to 39C, and 40A to 40C, sensor disable keys 43, 45, and 47, a timer 48, a stacked sheet detection sensor 49, and an alarming device 51. These elements are electrically connected to the control device 50, and signals are input/output between the elements and the control device 50.

The operator first turns on the print key 25A. After confirming that there is no one around the sheet stacking apparatus 1, the operator turns on the reset key 25B. The driving motor 26 is thus driven, and the printing press starts operating. When the operator turns on the print end key 27, the driving motor 26 stops driving, and the printing press stops operating.

Every time several sheets 3 are stacked on the pallet 15, the sheet height detection sensor 28 detects it so that the pile board hoist motor 9 is driven. The pile board 11 automatically moves downward bit by bit to always maintain a predetermined height of the stacked sheets 3.

When a predetermined number of stacked sheets 3 have been stacked on the pallet 15, or the remaining load capacity of the pallet 15 is getting low, the operator operates the feed stop key 29. This stops the operation of supplying the sheets 3 from a feed apparatus (not shown). After switching lowering of the pile board 11 from the automatic mode to the manual mode, the operator repeatedly operates the pile board lowering key 30, thereby moving the pile board 11 down to a predetermined position. When the limit switch 31 detects the pile board 11 that has moved down to the predetermined position by operating the pile board lowering key 30, driving of the motor 9 stops.

Figure 5:
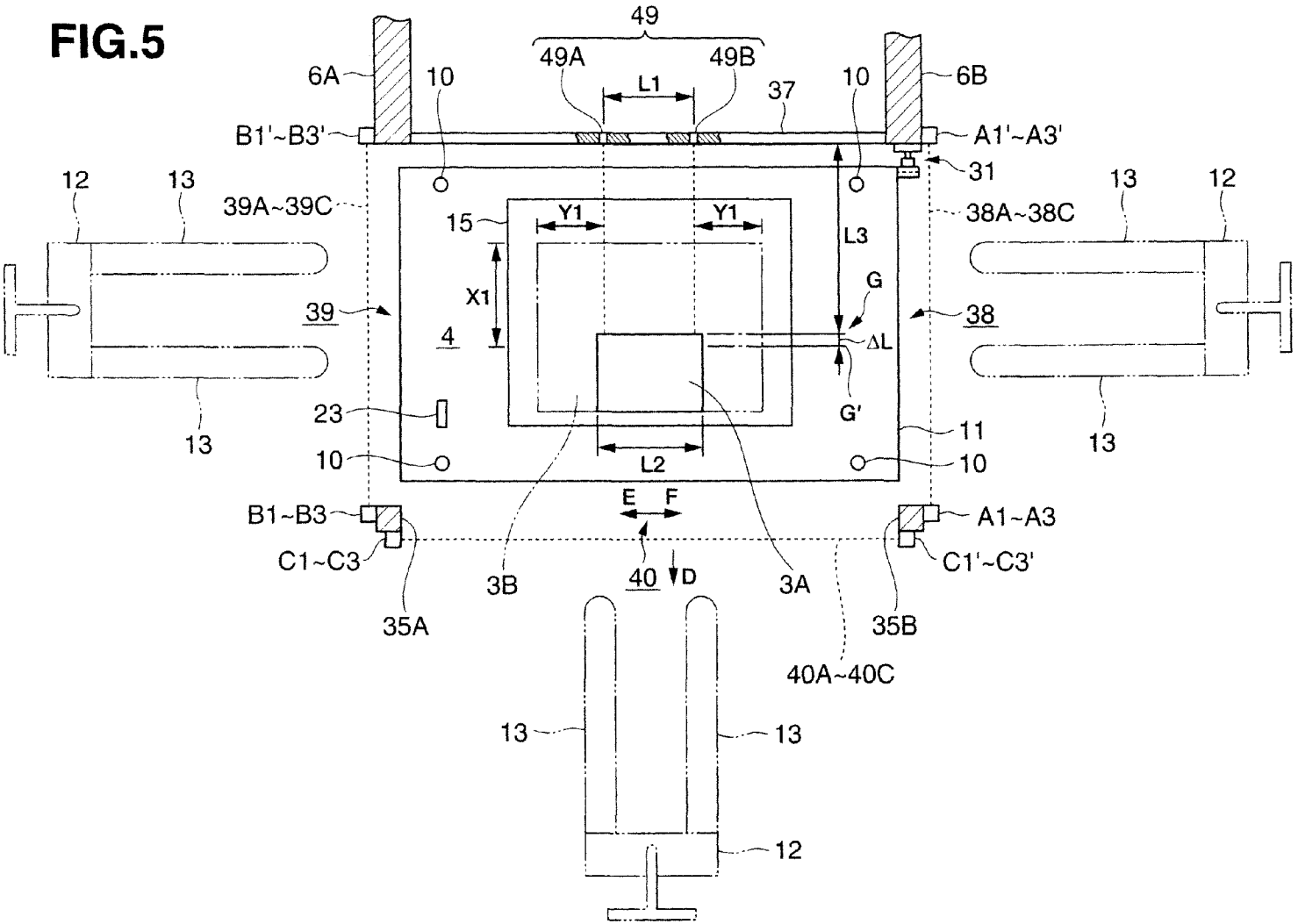
FIG. 5 is a plan view of the apparatus according to the first embodiment shown in FIG. 1.

As shown in FIGS. 2 and 5, columns 35A and 35B support the rear end portions of the pair of delivery frames 6A and 6B, respectively. A partition plate 37 is provided between the rising portions of the pair of delivery frames 6A and 6B, i.e., in a direction perpendicular to the sheet conveyance direction on the upstream side of the sheet conveyance direction of the sheet stacking unit 4.

As shown in FIG. 5, a space 38 formed between the column 35B and the rising portion of the delivery frame 6B forms the first extraction portion 38. The pallet 15 is extractable from the sheet stacking unit 4 via the first extraction portion 38 in a direction (the direction of an arrow F) perpendicular to the sheet conveyance direction (the direction of an arrow D), i.e., outward from the frame.

A space 39 formed between the column 35A and the rising portion of the delivery frame 6A forms the second extraction portion 39. The pallet 15 is extractable from the sheet stacking unit 4 via the second extraction portion 39 in a direction (the direction of an arrow E) perpendicular to the sheet conveyance direction (the direction of the arrow D), i.e., outward from the frame.

A space 40 formed between the columns 35A and 35B forms the third extraction portion 40. The pallet 15 is extractable from the sheet stacking unit 4 via the third extraction portion 40 to the downstream side of the sheet conveyance direction (the direction of the arrow D). The first to third extraction portions 38, 39, and 40 have the detection sensors 38A to 38C, 39A to 39C, and 40A to 40C for detecting entering of the operator or an external object such as a conveyance equipment into the sheet stacking unit 4, respectively.

As shown in FIG. 1, phototransmitters A1, A2, and A3 are fixed at the upper, middle, and lower portions of the column 35B. On the other hand, photodetectors A1', A2', and A3' are fixed at the upper, middle, and lower portions of the rising portion of the delivery frame 6B in correspondence with the phototransmitters A1, A2, and A3, respectively. The phototransmitter A1 and the photodetector A1' form the detection sensor 38A. The phototransmitter A2 and the photodetector A2' form the detection sensor 38B. The phototransmitter A3 and the photodetector A3' form the detection sensor 38C.

As shown in FIG. 2, phototransmitters B1, B2, and B3 are fixed at the upper, middle, and lower portions of the column 35A. On the other hand, photodetectors B1', B2', and B3' corresponding to the phototransmitters B1, B2, and B3 are fixed at the upper, middle, and lower portions of the rising portion of the delivery frame 6A, respectively. The phototransmitter B1 and the photodetector B1' form the detection sensor 39A. The phototransmitter B2 and the photodetector B2' form the detection sensor 39B. The phototransmitter B3 and the photodetector B3' form the detection sensor 39C.

As shown in FIG. 2, phototransmitters C1, C2, and C3 are fixed at the upper, middle, and lower portions of the column 35A. On the other hand, photodetectors C1', C2', and C3' corresponding to the phototransmitters C1, C2, and C3 are fixed at the upper, middle, and lower portions of the column 35B, respectively. The phototransmitter C1 and the photodetector C1' form the detection sensor 40A. The phototransmitter C2 and the photodetector C2' form the detection sensor 40B. The phototransmitter C3 and the photodetector C3' form the detection sensor 40C. The detection sensors 38A to 38C, 39A to 39C, or 40A to 40C function as first detection sensors.

As shown in FIG. 1, a detection cancel key 42 and the detection cancel key 43 (FIG. 4) are attached to the delivery frame 6B. When the detection cancel key 42 is turned on, only the detection sensor 38A is disabled. When the detection cancel key 43 is turned on, only the detection sensor 38C is disabled.

As shown in FIG. 2, a detection cancel key 44 and the detection cancel key 45 (FIG. 4) are attached to the delivery frame 6A. When the detection cancel key 44 is turned on, only the detection sensor 39A is disabled. When the detection cancel key 45 is turned on, only the detection sensor 39C is disabled.

As shown in FIG. 2, a detection cancel key 46 and the detection cancel key 47 (FIG. 4) are attached to the column 35B. When the detection cancel key 46 is turned on, only the detection sensor 40A is disabled. When the detection cancel key 47 is turned on, only the detection sensor 40C is disabled.

The timer 48 (FIG. 4) starts measurement when one of the detection cancel keys 43, 45, and 47 is turned on. When the stacked sheet detection sensor 49 (second detection sensor) detects the movement of stacked sheets, the timer 48 starts measurement.

As shown in FIG. 5, the stacked sheet detection sensor 49 is formed from a pair of distance sensors 49A and 49B that are attached to the central portion of the partition plate 37 while being spaced apart at an interval L1. That is, the pair of distance sensors 49A and 49B are juxtaposed in a direction perpendicular to the sheet conveyance direction. The pair of distance sensors 49A and 49B are arranged toward the downstream side of the sheet conveyance direction in a direction parallel to the sheet conveyance direction. The distance sensors 49A and 49B are oriented in a direction parallel to the sheet conveyance direction. When the forklift 12 has moved the trailing edges (edges on the upstream side of the sheet conveyance direction) of sheets 3A of minimum size stacked on the pallet 15 to a predetermined position by ΔL to the downstream side of the sheet conveyance direction (the direction of the arrow D), the stacked sheet detection sensor 49 detects the movement of the sheets 3A.

Figure 11:
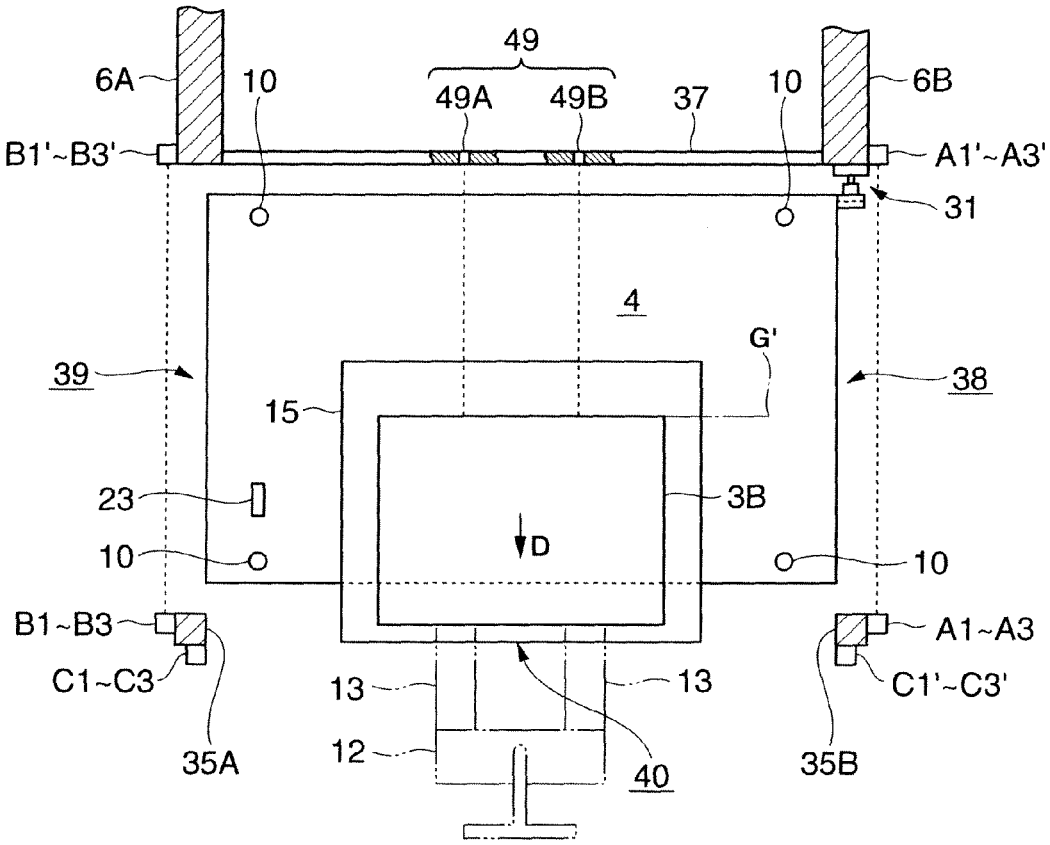
FIG. 11 is a view for explaining a case in which sheets of maximum size are extracted from the downstream side of the sheet conveyance direction in the apparatus according to the first embodiment shown in FIG. 1.

More specifically, when the trailing edges of the sheets 3 have moved from a position G, which is apart from the distance sensors 49A and 49B by a distance L3, to a position G' by ΔL in the direction of the arrow D, the stacked sheet detection sensor 49 detects the movement of the sheets 3 in the direction of the arrow D. In addition, when sheets 3B of maximum size stacked on the pile board have moved in the direction of the arrow D, and their trailing edges locate at the position G', as shown in FIG. 11, the stacked sheet detection sensor 49 detects the movement of the sheets 3B of maximum size in the direction of the arrow D.

The interval L1 between the distance sensors 49A and 49B is set to be shorter than a widthwise length L2 of the sheet 3A of minimum size. With this arrangement, the distance sensors 49A and 49B also detect the movement of the sheets 3 in the widthwise direction (the directions of the arrows E and F). More specifically, when both the distance sensors 49A and 49B detect the sheets 3 first, and one distance sensor 49A then detects the trailing edges of the sheets 3 no longer, the sensors detect the movement of the sheets 3 in the direction of the arrow F. Similarly, when the other distance sensor 49B detects the trailing edges of the sheets 3 no longer, the sensors detect the movement of the sheets 3 in the direction of the arrow E.

When one of the detection sensors 38A to 38C, 39A to 39C, and 40A to 40C detects an object during printing, the control device 50 (FIG. 4) stops the driving motor 26 to stop the operation of the printing press. Accordingly, the sheet conveyance operation of the delivery chains 2 also stops. The control device 50 controls the enabled/disabled states of the detection sensors 38A to 38C, 39A to 39C, and 40A to 40C in accordance with the outputs from the detection cancel keys 43, 45, and 47, distance sensors 49A and 49B, timer 48, and the like, as will be described later. More specifically, when the detection cancel key 43 is turned on, the control device 50 disables the detection sensor 38C. If the distance sensor 49A detects the sheets 3 no longer after the operation of the detection cancel key 43, the control device 50 disables the detection sensors 38A and 38B.

When the detection cancel key 43 is turned on, the control device 50 causes the timer 48 to start the measuring operation. If the stacked sheet detection sensor 49 does not detect the movement of the sheets 3 in the direction of the arrow F within a predetermined time after the start of the measuring operation, the control device 50 activates the alarming device 51, and simultaneously enables the detection sensor 38C.

When the stacked sheet detection sensor 49 detects the movement of the sheets 3 in the direction of the arrow F, the control device 50 causes the timer 48 to start the measuring operation. When a predetermined time has elapsed from the start of the measuring operation, the control device 50 switches the detection sensors 38A, 38B, and 38C from the disabled state to the enabled state. If the sheets 3 have not been extracted from the first extraction portion 38 within the predetermined time, the detection sensors 38A, 38B, and 38C detect the sheets 3 or the fork 13 of the fork 13 that has entered the sheet stacking unit 4, and the alarming device 51 operates.

When the detection cancel key 45 is turned on, the control device 50 disables the detection sensor 39C. If the distance sensor 49B detects the sheets 3 no longer after the operation of the detection cancel key 45, the control device 50 disables the detection sensors 39A and 39B. When the detection cancel key 43 is turned on, the control device 50 causes the timer 48 to start the measuring operation. If the stacked sheet detection sensor 49 does not detect the movement of the sheets 3 in the direction of the arrow E within a predetermined time after the start of the measuring operation, the control device 50 activates the alarming device 51, and simultaneously enables the detection sensor 39C.

When the stacked sheet detection sensor 49 detects the movement of the sheets 3 in the direction of the arrow E, the control device 50 causes the timer 48 to start the measuring operation. When a predetermined time has elapsed from the start of the measuring operation, the control device 50 switches the detection sensors 39A, 39B, and 39C from the disabled state to the enabled state. If the sheets 3 have not been extracted from the second extraction portion 39 within the predetermined time, the detection sensors 39A, 39B, and 39C detect the sheets 3 or the fork 13 of the fork 13 that has entered the sheet stacking unit 4, and the alarming device 51 operates.

When the detection cancel key 47 is turned on, the control device 50 disables the detection sensor 40C. If the distance sensors 49A and 49B detect the movement of the sheets 3 to the position G' after the operation of the detection cancel key 47, the control device 50 disables the detection sensors 40A and 40B. When the detection cancel key 45 is turned on, the control device 50 causes the timer 48 to start the measuring operation. If the stacked sheet detection sensor 49 does not detect the movement of the sheets 3 in the direction of the arrow D within a predetermined time after the start of the measuring operation, the control device 50 activates the alarming device 51, and simultaneously enables the detection sensor 40C.

When the stacked sheet detection sensor 49 detects the movement of the sheets 3 in the direction of the arrow D, the control device 50 causes the timer 48 to start the measuring operation. When a predetermined time has elapsed from the start of the measuring operation, the control device 50 switches the detection sensors 40A, 40B, and 40C from the disabled state to the enabled state. If the sheets 3 have not been extracted from the third extraction portion 40 within the predetermined time, the detection sensors 40A, 40B, and 40C detect the sheets 3 or the fork 13 of the fork 13 that has entered the sheet stacking unit 4, and the alarming device 51 operates.

An operation of stacking sheets on the pallet 15 and an operation of extracting the sheets 3 stacked on the pallet 15 from the extraction portions 38 to 40 in the sheet stacking apparatus having the above-described arrangement will be described next. First, the pallet 15 is mounted on the pile board 11 that has come down in the sheet stacking unit 4, and the pile board 11 is moved up to the hoisting limit position.

When the print key 25A is turned on in this state, the driving motor 26 is driven to start the printing operation. Each printed sheet 3 is gripped by the gripper units 8 of the delivery chains 2, and conveyed as the delivery chains 2 run. Then, the sheet 3 is released from the gripper units 8 and drops at the conveyance termination portion.

The dropping sheet 3 is stacked on the pile board while being tense because its trailing edge is in slidable contact with and sucked by the suction wheel 20, and aligned as its leading edge abuts against the sheet lay 19. When the pile board 11 is set in the automatic lowering mode, the sheet height detection sensor 28 detects the height of the sheets 3 stacked on the pallet 15. Every time several sheets 3 are stacked, the pile board automatically moves downward bit by bit so that the upper surface of the stacked sheets 3 is always maintained at a predetermined height.

To extract a sample sheet of the sheets 3 stacked on the pallet 15 from the third extraction portion 40, the detection cancel key 46 is turned on to disable the detection sensor 40A. For this reason, part (arm) of the operator, which has entered from the upper portion of the third extraction portion 40 into the sheet stacking unit 4, is not detected by the detection sensor 40A. It is therefore possible to extract the sample sheet from the sheets 3 stacked on the pallet 15.

To correct the position of the pallet 15 mounted on the pile board 11 from the first extraction portion 38, the detection cancel key 42 is turned on to disable the detection sensor 38A. For this reason, part (arm) of the operator, which has entered from the upper portion of the first extraction portion 38 into the sheet stacking unit 4, is not detected by the detection sensor 38A. It is therefore possible to correct the position of the pallet 15 mounted on the pile board 11. To correct the position of the pallet 15 on the pile board 11 from the second extraction portion 39, the detection cancel key 44 is turned on.

When a predetermined number of stacked sheets 3 have been stacked, or the remaining load capacity of the pallet 15 is getting low, the operator operates the feed stop key 29 to stop the operation of supplying the sheets 3 from the feed apparatus (not shown). Then, after switching the hoisting/lowering mode of the pile board 11 from the automatic mode to the manual mode, the operator operates the pile board lowering key 30, thereby moving the pile board 11 down. When the pile board 11 moves down to a predetermined position, the lowering limit switch 31 detects it, and the pile board 11 stops lowering.

Figure 6:
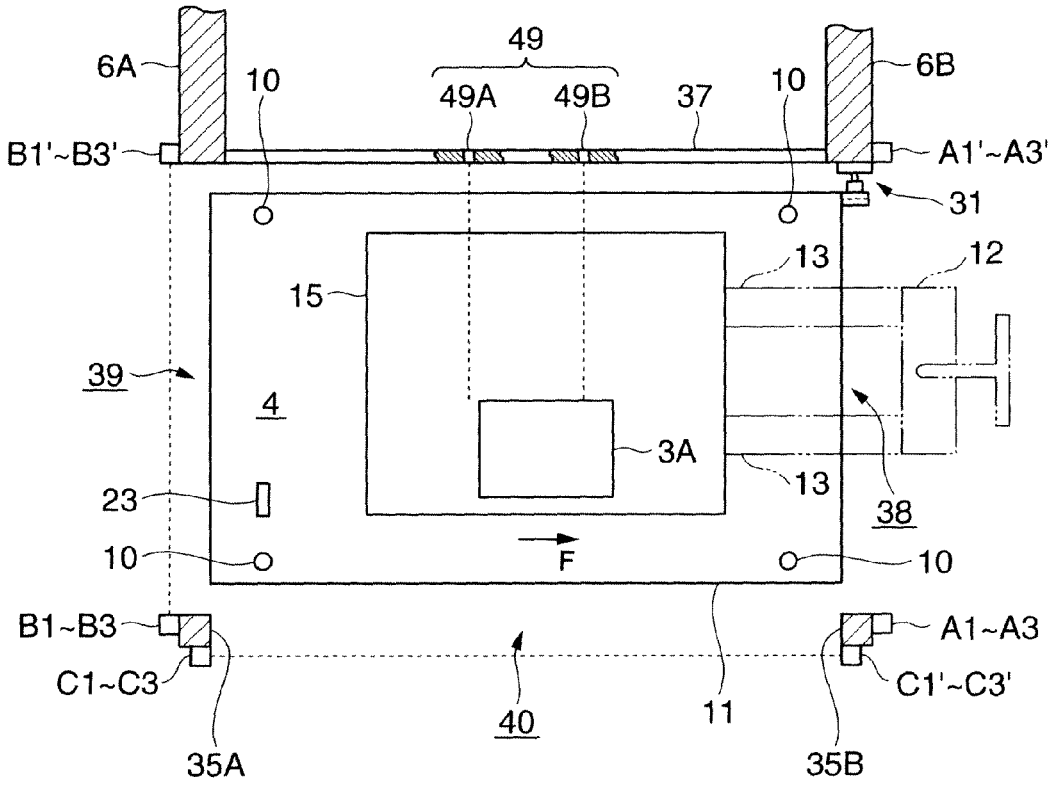
FIG. 6 is a view for explaining a case in which sheets of minimum size are extracted from a first direction perpendicular to the sheet conveyance direction in the apparatus according to the first embodiment shown in FIG. 1.

An operation of extracting the pallet 15 from the sheet stacking unit 4 using the forklift 12 will be described next. FIG. 6 shows a case in which the sheets 3A of minimum size are extracted from the first extraction portion 38. First, the operator turns on the detection cancel key 43 to disable the detection sensor 38C. Simultaneously, the timer 48 starts the measuring operation.

Figure 3:
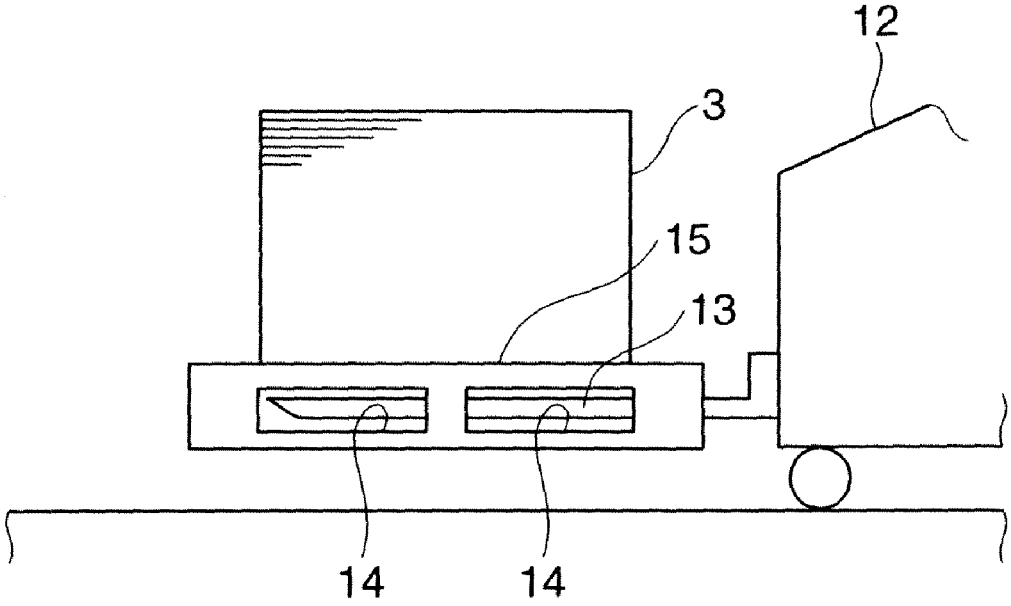
FIG. 3 is a view showing a state in which the delivery unit shown in FIG. 1 is delivering stacked sheets.

Next, the operator inserts the fork 13 of the forklift 12 from the first extraction portion 38 into the sheet stacking unit 4. As shown in FIG. 3, the fork 13 is inserted into the holes 14 of the pallet 15. The pallet 15 is supported by the fork 13 and moved in the direction of the arrow F. If the distance sensor 49A detects the trailing edges of the sheets 3A no longer, the stacked sheet detection sensor 49 detects that the sheets 3A have moved in the direction of the arrow F. When the movement of the sheets 3A in the direction of the arrow F is detected, the detection sensors 38A and 38B are disabled, and the timer 48 starts the measuring operation. Note that before detection of the movement of the sheets 3A, the sheets 3A have not moved yet to the detection positions of the detection sensors 38A to 38C, as a matter of course.

This means that the detection sensors 38A to 38C are disabled during the predetermined time measured by the timer 48 after detection of the movement of the sheets 3A by the stacked sheet detection sensor 49. Hence, the pallet 15 with the sheets 3A stacked on it can be extracted from the first extraction portion 38 by the forklift 12 without being detected by the detection sensors 38A to 38C.

In this way, after the detection cancel key 43 is operated to disable the detection sensor 38C, the stacked sheet detection sensor 49 detects the movement of the sheets, thereby disabling the remaining detection sensors 38A and 38B. This simplifies the operation of disabling the sensors, and also allows to prevent such an operation error that the operator forgets the operation of disabling the detection sensors 38A and 38B.

Figure 7:
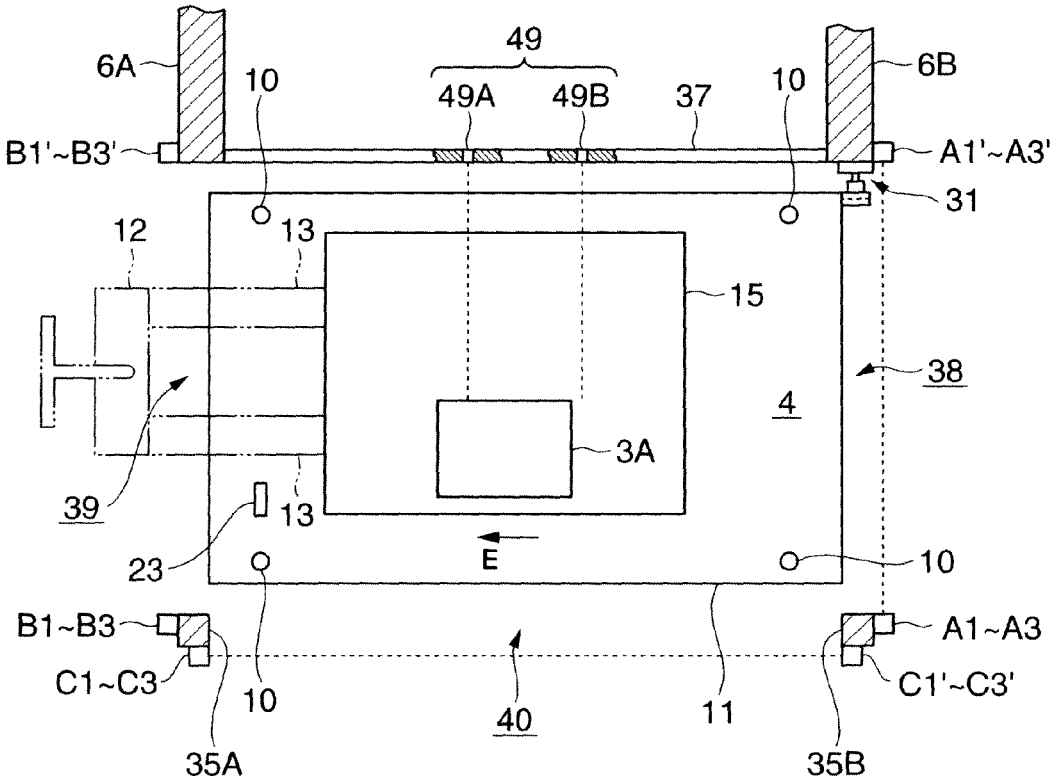
FIG. 7 is a view for explaining a case in which sheets of minimum size are extracted from a second direction perpendicular to the sheet conveyance direction in the apparatus according to the first embodiment shown in FIG. 1.

An operation of extracting the sheets 3A of minimum size from the second extraction portion 39 will be described next with reference to FIG. 7. First, the operator turns on the detection cancel key 45 to disable the detection sensor 39C. Simultaneously, the timer 48 starts the measuring operation.

Next, the operator inserts the fork 13 of the forklift 12 from the second extraction portion 39 into the sheet stacking unit 4. As shown in FIG. 3, the fork 13 is inserted into the holes 14 of the pallet 15. The pallet 15 is supported by the fork 13 and moved in the direction of the arrow E. If the distance sensor 49B detects the trailing edges of the sheets 3A no longer, the stacked sheet detection sensor 49 detects that the sheets 3A have moved in the direction of the arrow E. When the movement of the sheets 3A in the direction of the arrow E is detected, the detection sensors 39A and 39B are disabled, and the timer 48 starts the measuring operation.

This means that the detection sensors 39A to 39C are disabled during the predetermined time measured by the timer 48 after detection of the movement of the sheets 3A by the stacked sheet detection sensor 49. Hence, the pallet 15 with the sheets 3A stacked on it can be extracted from the second extraction portion 39 by the forklift 12 without being detected by the detection sensors 39A to 39C.

In this way, the operation of the detection cancel key 45 for disabling the detection sensor 39C is combined with detection by the stacked sheet detection sensor 49, thereby disabling the remaining detection sensors 39A and 39B. This simplifies the operation of disabling the sensors, and also allows to prevent such an operation error that the operator forgets the operation of disabling the detection sensors 39A and 39B.

Figure 8:
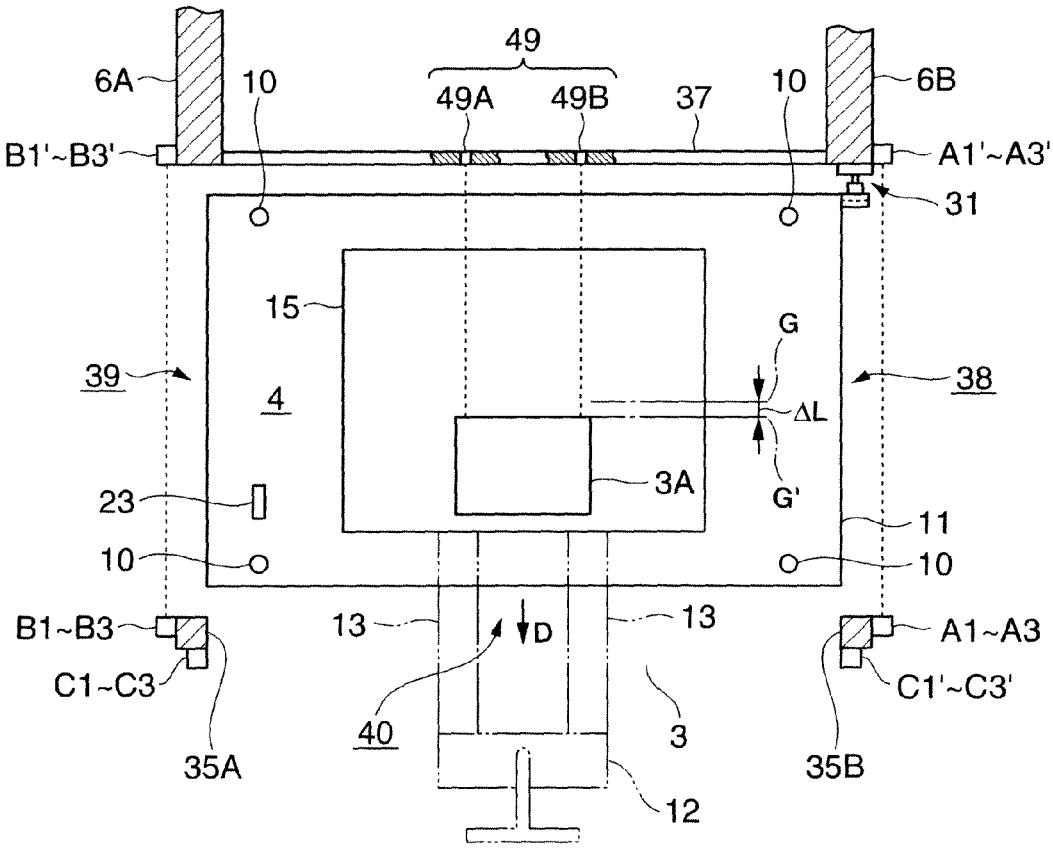
FIG. 8 is a view for explaining a case in which sheets of minimum size are extracted from the downstream side of the sheet conveyance direction in the apparatus according to the first embodiment shown in FIG. 1.

An operation of extracting the sheets 3A of minimum size from the third extraction portion 40 will be described next with reference to FIG. 8. First, the operator turns on the detection cancel key 47 to disable the detection sensor 40C. Simultaneously, the timer 48 starts the measuring operation.

Next, the operator inserts the fork 13 of the forklift 12 from the third extraction portion 40 into the sheet stacking unit 4. As shown in FIG. 3, the fork 13 is inserted into the holes 14 of the pallet 15. The pallet 15 is supported by the fork 13 and moved in the direction of the arrow D. If the trailing edges of the sheets 3A move from the stacking position G in the direction of the arrow D by $\Delta L$, the pair of distance sensors 49A and 49B detect that the sheets 3A have moved in the direction of the arrow D. When the movement of the sheets 3A in the direction of the arrow D is detected, the detection sensors 40A and 40B are disabled, and the timer 48 starts the measuring operation.

This means that the detection sensors 40A to 40C are disabled during the predetermined time measured by the timer 48 after detection of the movement of the sheets 3A by the stacked sheet detection sensor 49. Hence, the pallet 15 with the sheets 3A stacked on it can be extracted from the third extraction portion 40 by the forklift 12 without being detected by the detection sensors 40A to 40C.

In this way, after the operator operates the detection cancel key 47 to disable the detection sensor 40C, the stacked sheet detection sensor 49 detects the movement of the sheets, thereby disabling the remaining detection sensors 40A and 40B. This simplifies the operation of disabling the sensors, and also allows to prevent such an operation error that the operator forgets the operation of disabling the detection sensors 40A and 40B.

Figure 9:
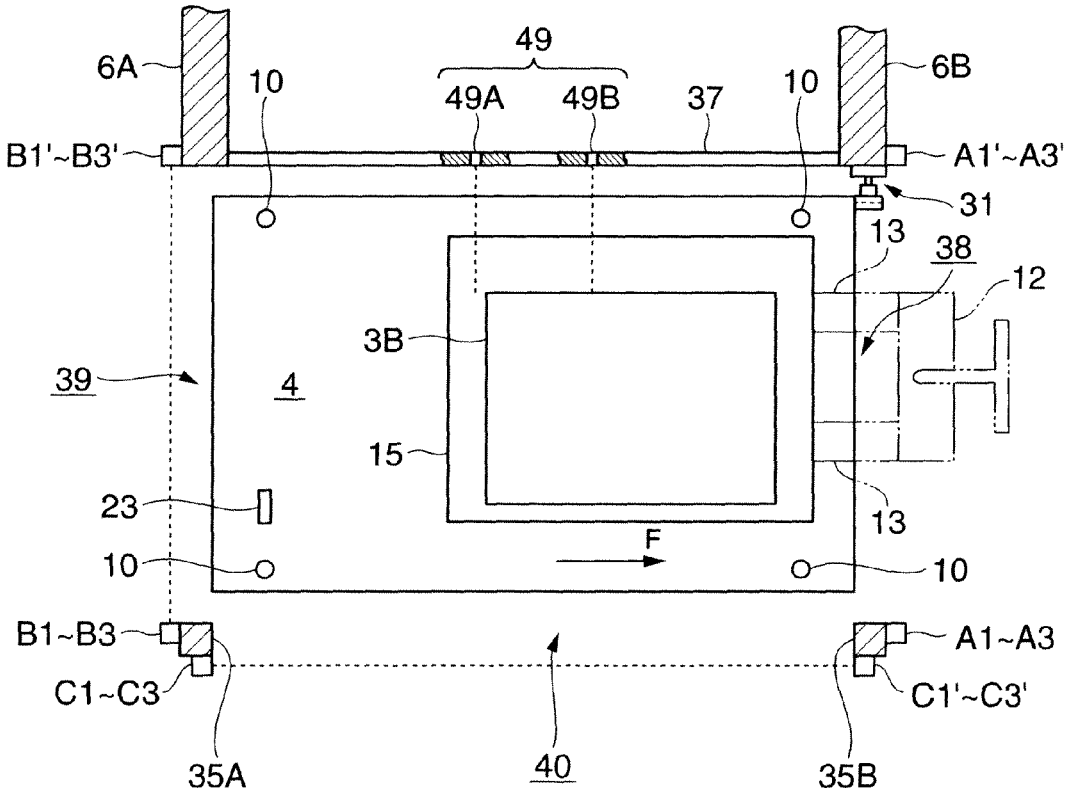
FIG. 9 is a view for explaining a case in which sheets of maximum size are extracted from the first direction perpendicular to the sheet conveyance direction in the apparatus according to the first embodiment shown in FIG. 1.

An operation of extracting the sheets 3B of maximum size from the first extraction portion 38 will be described next with reference to FIG. 9. First, the operator turns on the detection cancel key 43 to disable the detection sensor 38C. Simultaneously, the timer 48 starts the measuring operation.

Next, the operator inserts the fork 13 of the forklift 12 from the first extraction portion 38 into the sheet stacking unit 4. As shown in FIG. 3, the fork 13 is inserted into the holes 14 of the pallet 15. The pallet 15 is supported by the fork 13 and moved in the direction of the arrow F. If the distance sensor 49A detects the trailing edges of the sheets 3B no longer, the stacked sheet detection sensor 49 detects that the sheets 3B have moved in the direction of the arrow F. When the movement of the sheets 3B in the direction of the arrow F is detected, the detection sensors 38A and 38B are disabled, and the timer 48 starts the measuring operation.

This means that the detection sensors 38A to 38C are disabled during the predetermined time measured by the timer 48 after detection of the movement of the sheets 3B by the stacked sheet detection sensor 49. Hence, the pallet 15 with the sheets 3B stacked on it can be extracted from the first extraction portion 38 by the forklift 12 without being detected by the detection sensors 38A to 38C.

In this way, the operation of the detection cancel key 43 by operator for disabling the detection sensor 38C is combined with detection by the stacked sheet detection sensor 49, thereby disabling the remaining detection sensors 38A and 38B. This simplifies the operation of disabling the sensors, and also allows to prevent such an operation error that the operator forgets the operation of disabling the detection sensors 38A and 38B.

Figure 10:
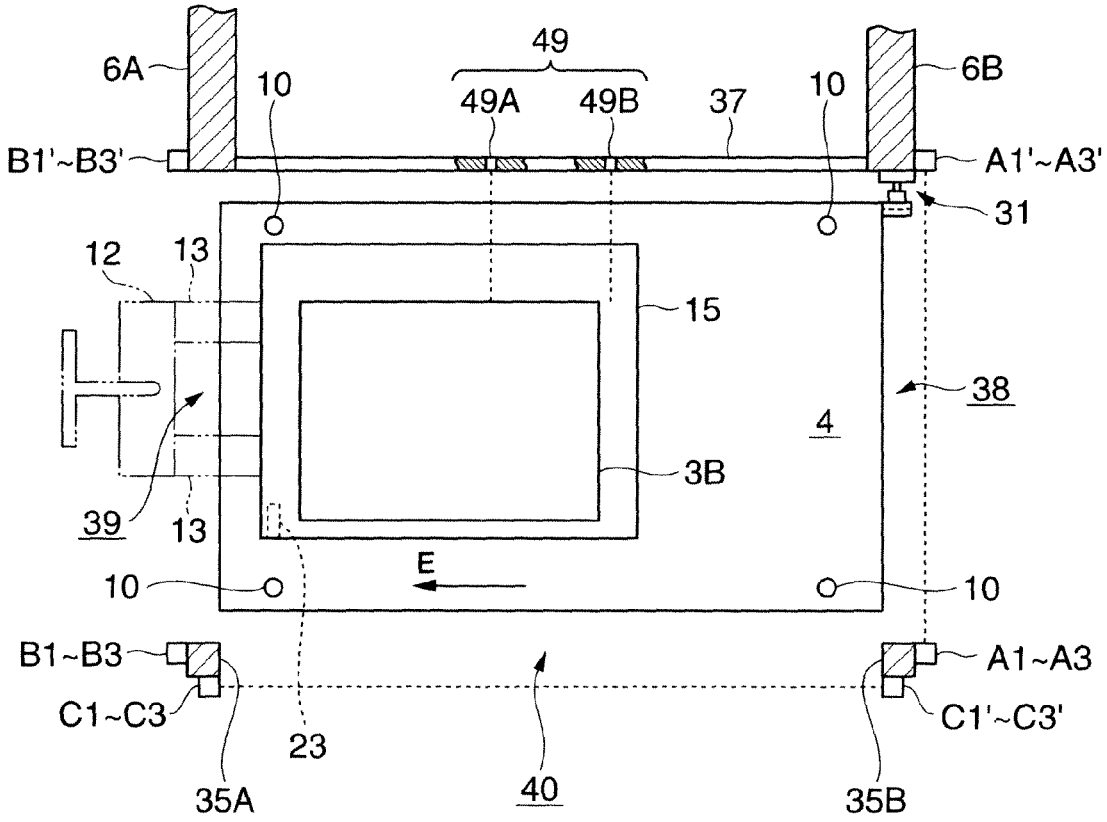
FIG. 10 is a view for explaining a case in which sheets of maximum size are extracted from the second direction perpendicular to the sheet conveyance direction in the apparatus according to the first embodiment shown in FIG. 1.

An operation of extracting the sheets 3B of maximum size from the second extraction portion 39 will be described next with reference to FIG. 10. First, the operator turns on the detection cancel key 45 to disable the detection sensor 39C. Simultaneously, the timer 48 starts the measuring operation.

Next, the operator inserts the fork 13 of the forklift 12 from the second extraction portion 39 into the sheet stacking unit 4. As shown in FIG. 3, the fork 13 is inserted into the holes 14 of the pallet 15. The pallet 15 is supported by the fork 13 and moved in the direction of the arrow E. If the distance sensor 49B detects the trailing edges of the sheets 3B no longer, the stacked sheet detection sensor 49 detects that the sheets 3B have moved in the direction of the arrow E. When the movement of the sheets 3B in the direction of the arrow E is detected, the detection sensors 39A and 39B are disabled, and the timer 48 starts the measuring operation.

This means that the detection sensors 39A to 39C are disabled during the predetermined time measured by the timer 48 after detection of the movement of the sheets 3B by the stacked sheet detection sensor 49. Hence, the pallet 15 with the sheets 3B stacked on it can be extracted from the second extraction portion 39 by the forklift 12 without being detected by the detection sensors 39A to 39C.

In this way, the operation of the detection cancel key 45 for disabling the detection sensor 39C is combined with detection by the stacked sheet detection sensor 49, thereby disabling the remaining detection sensors 39A and 39B. This simplifies the operation of disabling the sensors, and also allows to prevent such an operation error that the operator forgets the operation of disabling the detection sensors 39A and 39B.

An operation of extracting the sheets 3B of maximum size from the third extraction portion 40 will be described next with reference to FIG. 11. First, the operator turns on the detection cancel key 47 to disable the detection sensor 40C. Simultaneously, the timer 48 starts the measuring operation.

Next, the operator inserts the fork 13 of the forklift 12 from the third extraction portion 40 into the sheet stacking unit 4. As shown in FIG. 3, the fork 13 is inserted into the holes 14 of the pallet 15. The pallet 15 is supported by the fork 13 and moved in the direction of the arrow D. If the trailing edges of the sheets 3B move from the stacking position to the position G' in the direction of the arrow D, the pair of distance sensors 49A and 49B detect that the sheets 3B have moved in the direction of the arrow D. When the movement of the sheets 3B in the direction of the arrow D is detected, the detection sensors 40A and 40B are disabled, and the timer 48 starts the measuring operation.

This means that the detection sensors 40A to 40C are disabled during the predetermined time measured by the timer 48 after detection of the movement of the sheets 3B by the stacked sheet detection sensor 49. Hence, the pallet 15 with the sheets 3B stacked on it can be extracted from the third extraction portion 40 by the forklift 12 without being detected by the detection sensors 40A to 40C.

In this way, the operation of the detection cancel key 47 for disabling the detection sensor 40C is combined with detection by the stacked sheet detection sensor 49, thereby disabling the remaining detection sensors 40A and 40B. This simplifies the operation of disabling the sensors, and also allows to prevent such an operation error that the operator forgets the operation of disabling the detection sensors 40A and 40B.

The pallet 15 on which the sheets 3A or 3B are stacked is extracted from the pile board 11 that has moved down via the first to third extraction portions 38 to 40. After that, an empty pallet 15 is mounted on the pile board 11. When the operator presses a push button (not shown), the pile board 11 is hoisted at a relatively high speed.

When the upper end of the pallet 15 has moved up to near the hoisting limit, the noncontact sensors 22 detect the detection rubber member 23. Upon detecting the detection rubber member 23, the motor 9 that winds up the hoist chains 10 switches from the high speed to a low speed so that the pile board 11 moves up at a low speed.

When the limit switch 21 detects the hoisting limit of the pile board 11, the motor 9 stops, and the pile board 11 stops moving up. In this state, the hoisting/lowering mode of the pile board 11 is switched from the manual mode to the automatic mode. Then, the delivery state is set, and the pile board 11 automatically lowers in accordance with the sheet load capacity.

Figure 12:
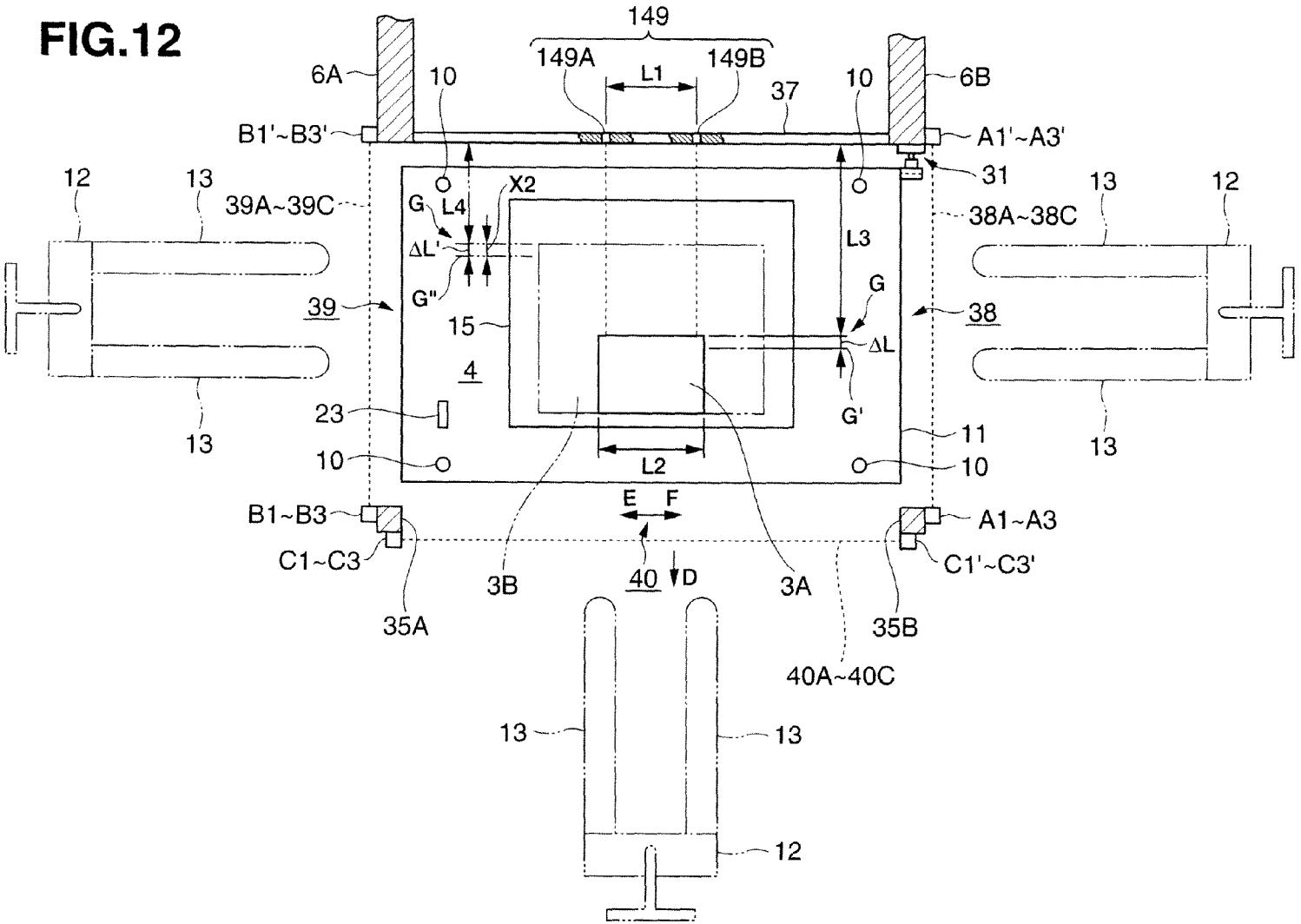
FIG. 12 is a view for explaining a case in which sheets of minimum and maximum sizes are extracted from the downstream side of the sheet conveyance direction in a sheet stacking apparatus according to the second embodiment of the present invention.

The second embodiment of the present invention will be described next with reference to FIG. 12.

For sheets 3A of minimum size, when a lowering limit switch 31 detects that a pile board 11 has located at the lowering limit, distance sensors 149A and 149B of a stacked sheet detection sensor 149 measure a distance L3 to the sheets 3A stacked on a pallet 15. After that, when a forklift 12 moves the trailing edges of the sheets 3A (end portions on the upstream side of the sheet conveyance direction) to the downstream side of the sheet conveyance direction (the direction of an arrow D) from a position G to a position G' by ΔL, the distance sensors 149A and 149B measure the distance (L3+ΔL) to the sheets 3A, thereby detecting the movement of the sheets 3A.

An operation of extracting the pallet 15 with the sheets 3A of minimum size stacked on it will be described next. First, the operator turns on a detection cancel key 47 to disable a detection sensor 40C. Simultaneously, a timer 48 starts measurement. Then, the forklift 12 moves the sheets 3A in the direction of the arrow D. When the distance between the sheets 3A and the distance sensors 149A and 149B increases to (L3+ΔL), the distance sensors 149A and 149B detect the movement of the sheets 3A. When the movement of the sheets 3A in the direction of the arrow D is detected, the detection sensors 40A and 40B are disabled, and the timer 48 starts the measuring operation.

This means that the detection sensors 40A to 40C are disabled during the predetermined time measured by the timer 48 after detection of the movement of the sheets 3A by the stacked sheet detection sensor 149. Hence, the pallet 15 with the sheets 3A stacked on it can be extracted from the third extraction portion 40 by the forklift 12 without being detected by the first detection sensors 40A to 40C.

For sheets 3B of maximum size, when the lowering limit switch 31 detects that the pile board 11 has located at the lowering limit, the distance sensors 149A and 149B measure a distance L4 to the sheets 3B stacked on the pallet 15. After that, when the forklift 12 moves the trailing edges of the sheets 3B (end portions on the upstream side of the sheet conveyance direction) to the downstream side of the sheet conveyance direction (the direction of the arrow D) from the position G to the position G' by ΔL', the distance sensors 149A and 149B measure the distance (L4+ΔL') to the sheets 3B, thereby detecting the movement of the sheets 3B.

An operation of extracting the pallet 15 with the sheets 3B of maximum size stacked on it will be described next. First, the operator turns on the detection cancel key 47 to disable the detection sensor 40C. Simultaneously, the timer 48 starts measurement. Then, the forklift 12 moves the sheets 3B in the direction of the arrow D. When the distance between the sheets 3B and the distance sensors 149A and 149B increases to (L4+ΔL'), the distance sensors 149A and 149B detect the movement of the sheets 3B. When the movement of the sheets 3B in the direction of the arrow D is detected, the detection sensors 40A and 40B are disabled, and the timer 48 starts the measuring operation.

This means that the detection sensors 40A to 40C are disabled during the predetermined time measured by the timer 48 after detection of the movement of the sheets 3B by the stacked sheet detection sensor 149. Hence, the pallet 15 with the sheets 3B stacked on it can be extracted from the third extraction portion 40 by the forklift 12 without being detected by the detection sensors 40A to 40C.

According to this embodiment, the distance sensors 149A and 149B thus measure the moving distance of the sheets (sheet end portions) in the direction of the arrow D. On the other hand, in the first embodiment shown in FIG. 5, movement of sheets (sheet end portions) to the absolute position G' is measured (detected). Hence, in the first embodiment, the movement of the sheets 3B of maximum size can be detected only when they move by a distance X1. In the second embodiment, however, the movement can be detected when the sheets 3B move by only a distance X2 (FIG. 12). This shortens the detection time. It is therefore possible to disable the detection sensors 40A and 40B in a short time after the sheets 3B start moving.

The third embodiment of the present invention will be described next with reference to FIGS. 13 to 19.

Figure 13:
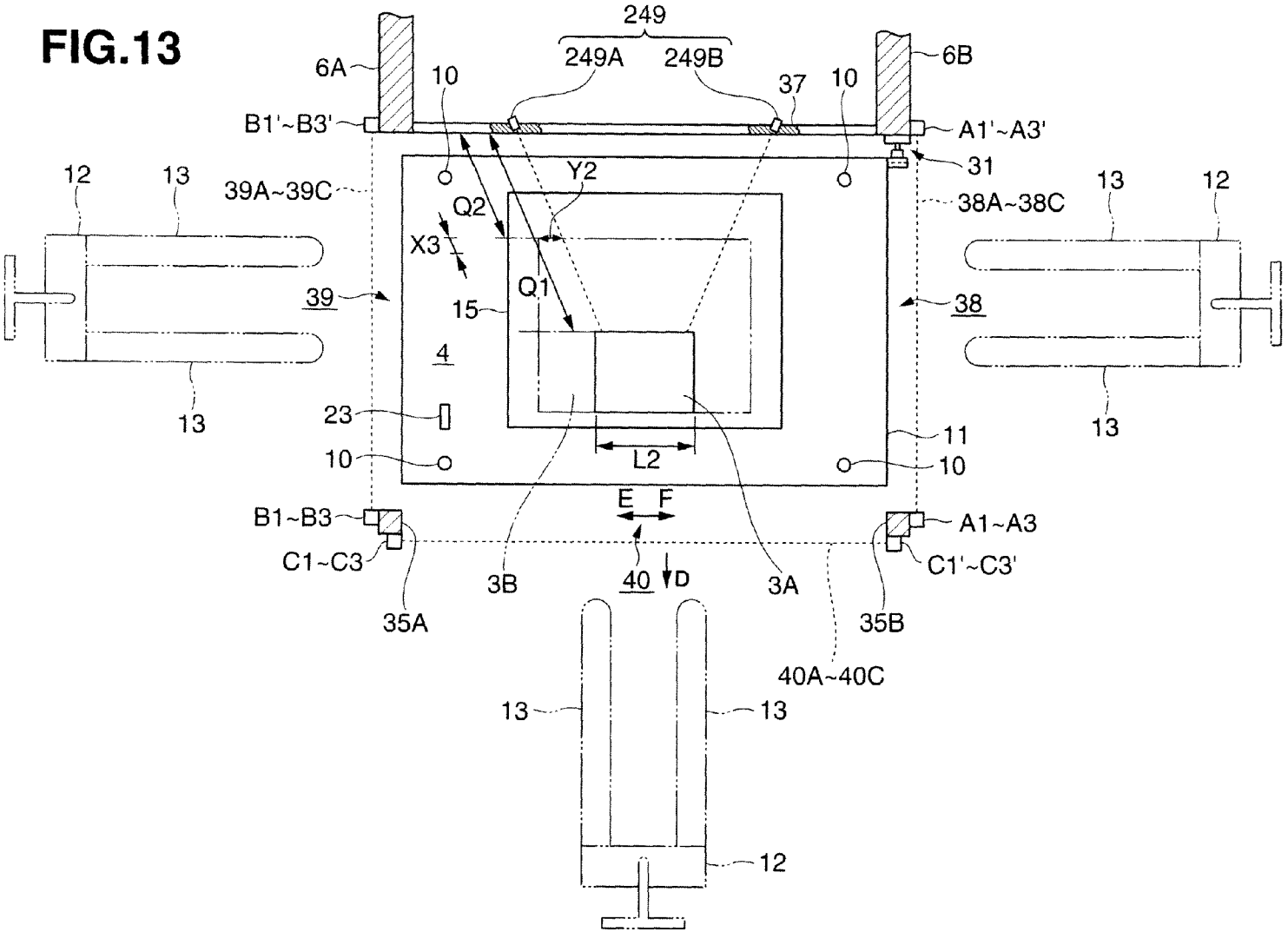
FIG. 13 is a view for explaining a case in which sheets of minimum and maximum sizes are extracted in a sheet stacking apparatus according to the third embodiment of the present invention.
Figure 14:
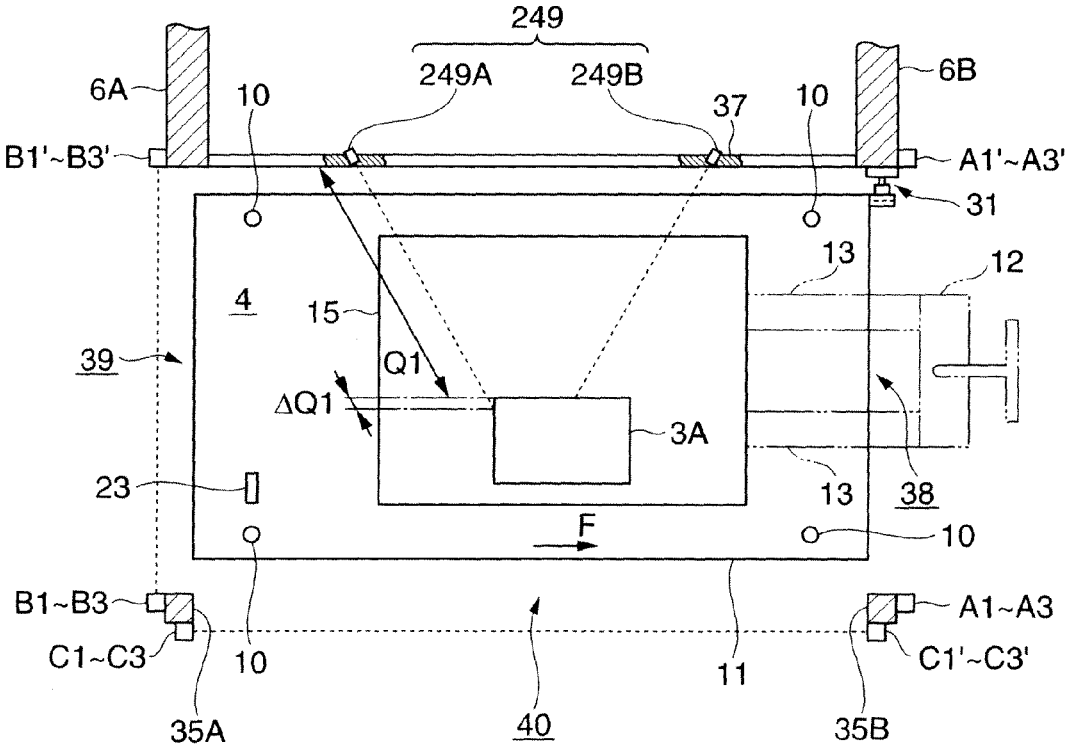
FIG. 14 is a view for explaining a case in which sheets of minimum size are extracted in a direction perpendicular to the sheet conveyance direction in the apparatus according to the third embodiment shown in FIG. 13.
Figure 15:
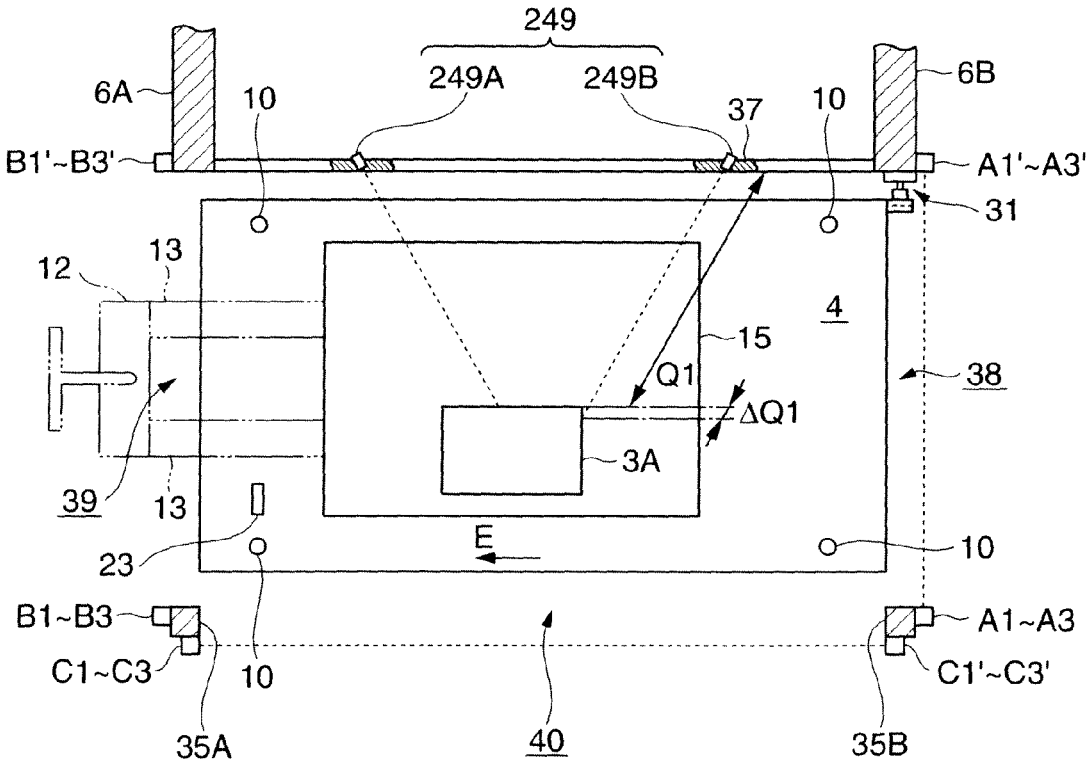
FIG. 15 is a view for explaining a case in which sheets of minimum size are extracted in another direction perpendicular to the sheet conveyance direction in the apparatus according to the third embodiment shown in FIG. 13.

In the third embodiment, distance sensors 249A and 249B oriented to the downstream side of the sheet conveyance direction are attached to a partition plate 37 while being tilted in directions opposite to each other at the same angle with respect to sheets 3A or 3B, as shown in FIG. 13. When extracting the sheets 3A of minimum size from a first extraction portion 38 or a second extraction portion 39, the distance sensors 249A and 249B detect the movement of the sheets 3A in the direction of an arrow F or E when a detection distance Q1 of one of the sensors becomes (Q1+ΔQ1) or more, as shown in FIG. 14 or 15.

Figure 16:
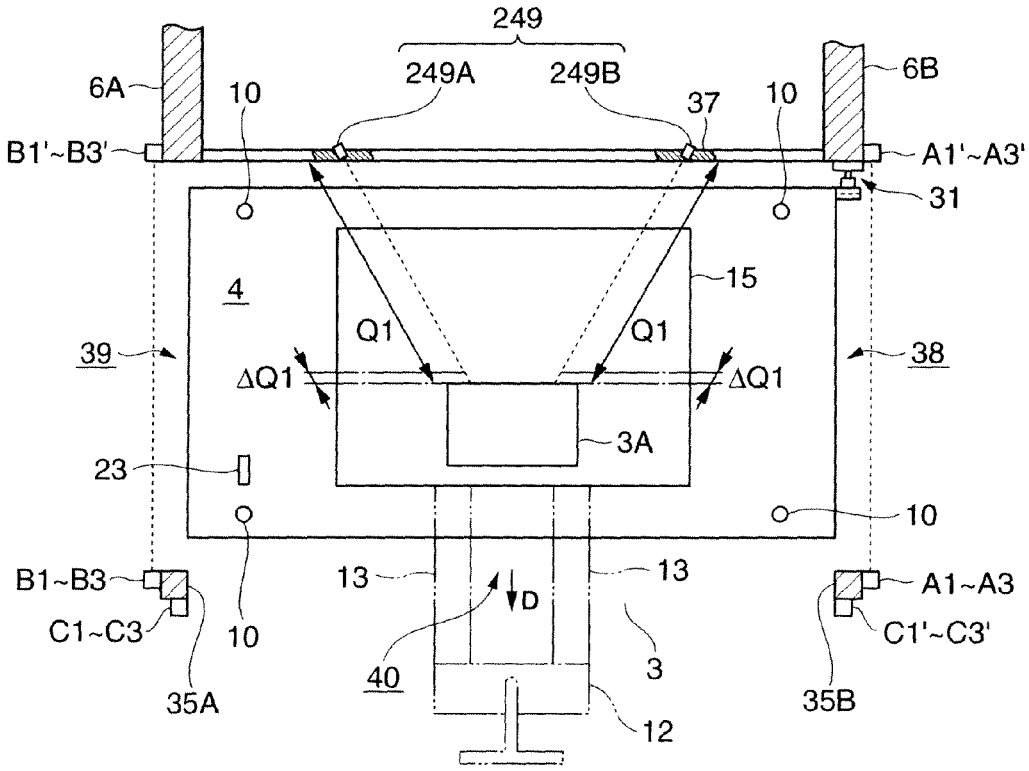
FIG. 16 is a view for explaining a case in which sheets of minimum size are extracted from the downstream side of the sheet conveyance direction in the apparatus according to the third embodiment shown in FIG. 13.

When extracting the sheets 3A from a third extraction portion 40, the distance sensors 249A and 249B detect the movement of the sheets 3A in the direction of an arrow D when the detection distances Q1 of both sensors become (Q1+ΔQ1), as shown in FIG. 16.

Figure 17:
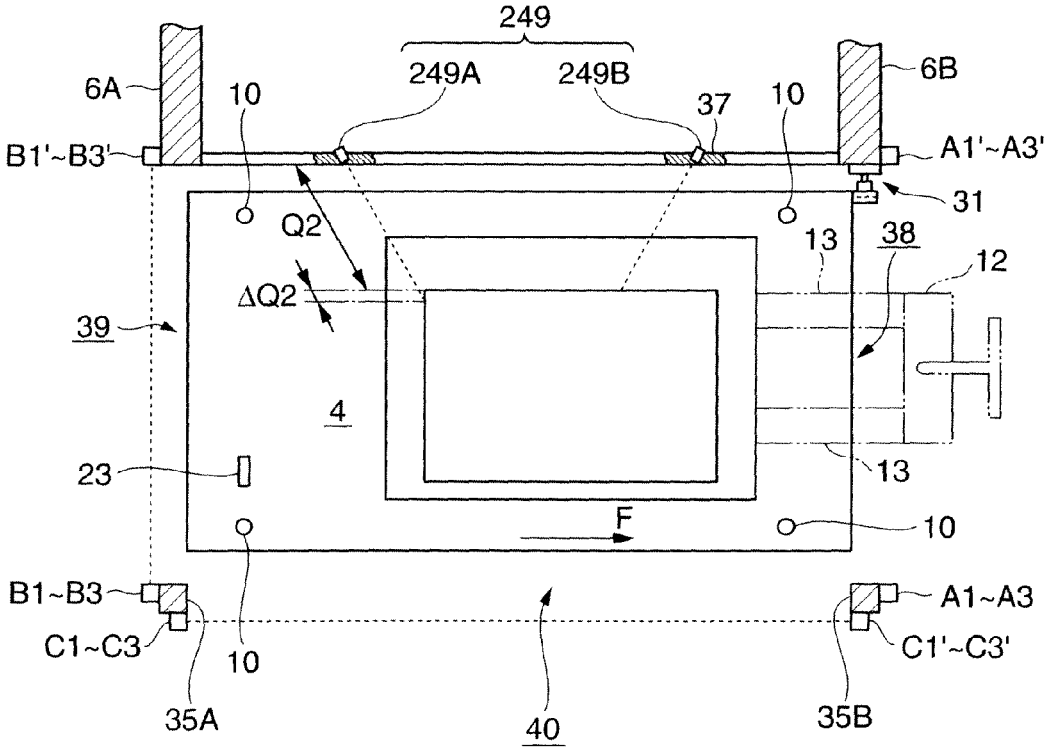
FIG. 17 is a view for explaining a case in which sheets of maximum size are extracted in a direction perpendicular to the sheet conveyance direction in the apparatus according to the third embodiment shown in FIG. 13.
Figure 18:
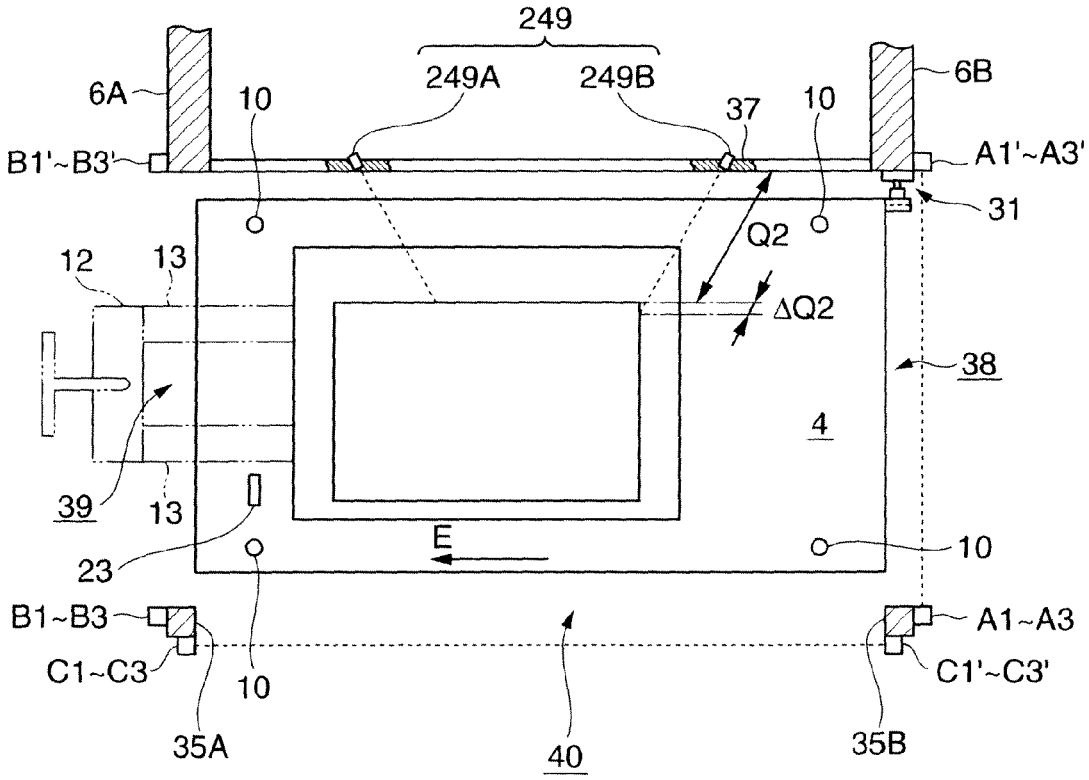
FIG. 18 is a view for explaining a case in which sheets of maximum size are extracted in another direction perpendicular to the sheet conveyance direction in the apparatus according to the third embodiment shown in FIG. 13.
Figure 19:
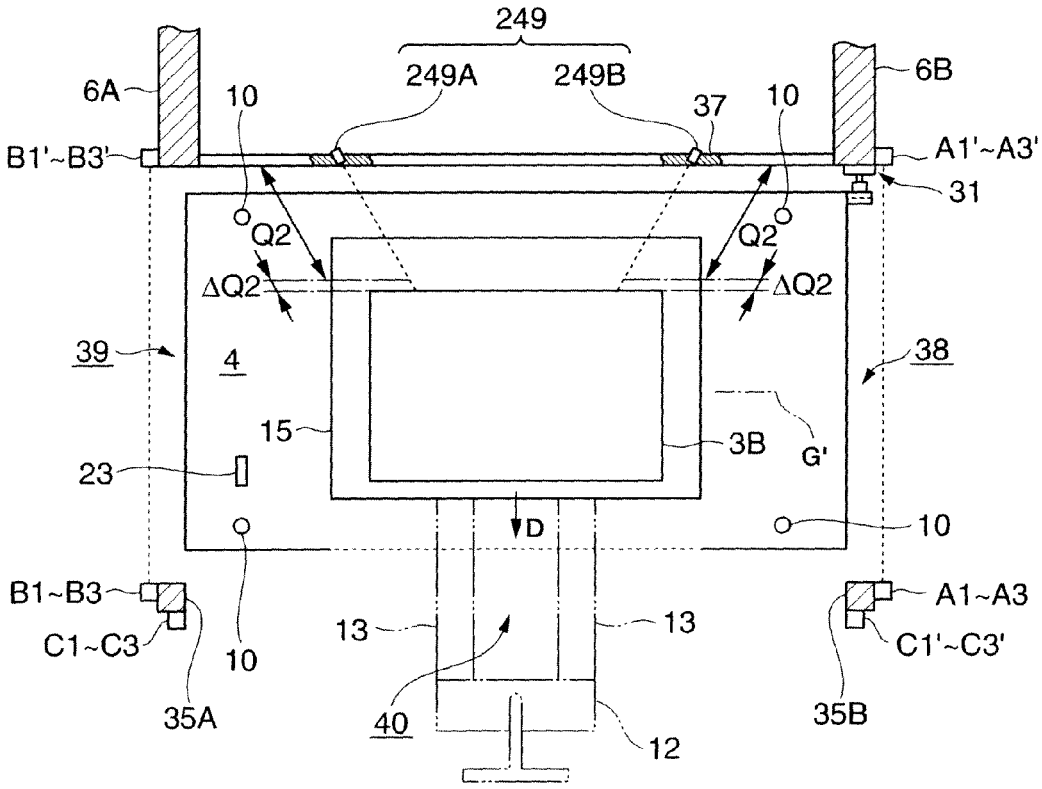
FIG. 19 is a view for explaining a case in which sheets of maximum size are extracted from the downstream side of the sheet conveyance direction in the apparatus according to the third embodiment shown in FIG. 13.

When extracting the sheets 3B of maximum size from the first extraction portion 38 or the second extraction portion 39, the distance sensors 249A and 249B detect the movement of the sheets 3B in the direction of the arrow F or E when a detection distance Q2 of one of the sensors becomes (Q2+ΔQ2) or more, as shown in FIG. 17 or 18. When extracting the sheets 3B from the third extraction portion 40, the distance sensors 249A and 249B detect the movement of the sheets 3A in the direction of the arrow D when the detection distances Q2 of both sensors become (Q2+ΔQ2) or more, as shown in FIG. 19.

An operation of extracting the sheets 3A of minimum size from the first extraction portion 38 will be described next with reference to FIG. 14. First, the operator turns on a detection cancel key 43 to disable a detection sensor 38C. Simultaneously, a timer 48 starts the measuring operation. Next, the sheets 3A move in the direction of the arrow F. When the distance between the distance sensor 249A and the sheets 3A becomes (Q1+ΔQ1), the movement of the sheets 3A is detected. When the movement of the sheets 3A in the direction of the arrow F is detected, detection sensors 38A and 38B are disabled, and the timer 48 starts the measuring operation.

This means that the detection sensors 38A to 38C are disabled during the predetermined time measured by the timer 48 after detection of the movement of the sheets 3A by a stacked sheet detection sensor 249. Hence, the pallet 15 with the sheets 3A stacked on it can be extracted from the first extraction portion 38 by the forklift 12 without being detected by the detection sensors 38A to 38C.

An operation of extracting the sheets 3A of minimum size from the second extraction portion 39 will be described next with reference to FIG. 15. First, the operator turns on a detection cancel key 45 to disable a detection sensor 39C. Simultaneously, the timer 48 starts the measuring operation. Next, the sheets 3A move in the direction of the arrow E. When the distance between the distance sensor 249B and the sheets 3A becomes (Q1+ΔQ1), the movement of the sheets 3A is detected. When the movement of the sheets 3A in the direction of the arrow E is detected, detection sensors 39A and 39B are disabled, and the timer 48 starts the measuring operation.

This means that the detection sensors 39A to 39C are disabled during the predetermined time measured by the timer 48 after detection of the movement of the sheets 3A by the stacked sheet detection sensor 249. Hence, the pallet 15 with the sheets 3A stacked on it can be extracted from the second extraction portion 39 by the forklift 12 without being detected by the detection sensors 39A to 39C.

An operation of extracting the sheets 3A of minimum size from the third extraction portion 40 will be described next with reference to FIG. 16. First, the operator turns on a detection cancel key 47 to disable a detection sensor 40C. Simultaneously, the timer 48 starts the measuring operation. Next, the sheets 3A move in the direction of the arrow D. When both the distances between the distance sensors 249A and 249B and the sheets 3A become (Q1+ΔQ1), the movement of the sheets 3A is detected. When the movement of the sheets 3A in the direction of the arrow D is detected, detection sensors 40A and 40B are disabled, and the timer 48 starts the measuring operation.

This means that the detection sensors 40A to 40C are disabled during the predetermined time measured by the timer 48 after detection of the movement of the sheets 3A by the stacked sheet detection sensor 249. Hence, the pallet 15 with the sheets 3A stacked on it can be extracted from the third extraction portion 40 by the forklift 12 without being detected by the detection sensors 40A to 40C.

An operation of extracting the sheets 3B of maximum size from the first extraction portion 38 will be described next with reference to FIG. 17. First, the operator turns on the detection cancel key 43 to disable the detection sensor 38C. Simultaneously, the timer 48 starts the measuring operation. Next, the sheets 3B move in the direction of the arrow F. When the distance between the distance sensor 249A and the sheets 3B becomes (Q2+ΔQ2), the movement of the sheets 3B is detected. When the movement of the sheets 3B in the direction of the arrow F is detected, the detection sensors 38A and 38B are disabled, and the timer 48 starts the measuring operation.

This means that the detection sensors 38A to 38C are disabled during the predetermined time measured by the timer 48 after detection of the movement of the sheets 3B by the stacked sheet detection sensor 249. Hence, the pallet 15 with the sheets 3B stacked on it can be extracted from the first extraction portion 38 by the forklift 12 without being detected by the detection sensors 38A to 38C.

An operation of extracting the sheets 3B of maximum size from the second extraction portion 39 will be described next with reference to FIG. 18. First, the operator turns on the detection cancel key 45 to disable the detection sensor 39C. Simultaneously, the timer 48 starts the measuring operation. Next, the sheets 3B move in the direction of the arrow E. When the distance between the distance sensor 249B and the sheets 3B becomes (Q2+ΔQ2), the movement of the sheets 3B is detected. When the movement of the sheets 3B in the direction of the arrow E is detected, the detection sensors 39A and 39B are disabled, and the timer 48 starts the measuring operation.

This means that the detection sensors 39A to 39C are disabled during the predetermined time measured by the timer 48 after detection of the movement of the sheets 3B by the stacked sheet detection sensor 249. Hence, the pallet 15 with the sheets 3B stacked on it can be extracted from the second extraction portion 39 by the forklift 12 without being detected by the detection sensors 39A to 39C.

An operation of extracting the sheets 3B of maximum size from the third extraction portion 40 will be described next with reference to FIG. 19. First, the operator turns on the detection cancel key 47 to disable the detection sensor 40C. Simultaneously, the timer 48 starts the measuring operation. Next, the sheets 3B move in the direction of the arrow D. When both the distances between the distance sensors 249A and 249B and the sheets 3B become (Q2+ΔQ2), the movement of the sheets 3B is detected. When the movement of the sheets 3B in the direction of the arrow D is detected, the detection sensors 40A and 40B are disabled, and the timer 48 starts the measuring operation.

This means that the detection sensors 40A to 40C are disabled during the predetermined time measured by the timer 48 after detection of the movement of the sheets 3B by the stacked sheet detection sensor 249. Hence, the pallet 15 with the sheets 3B stacked on it can be extracted from the third extraction portion 40 by the forklift 12 without being detected by the detection sensors 40A to 40C.

According to this embodiment, the distance sensors 249A and 249B thus measure the moving amount (moving distance) of the sheets (sheet end portions) in the direction of the arrow D. On the other hand, in the first embodiment shown in FIG. 5, movement of sheets (sheet end portions) to the absolute position G' in the direction of the arrow D is measured (detected). Hence, in the first embodiment, the movement of the sheets 3B of maximum size can be detected only when they move by a distance X1. In the third embodiment, however, the movement can be detected when the sheets 3B move by only a distance X2 (FIG. 13). This shortens the detection time. It is therefore possible to disable the detection sensors 40A and 40B in a short time after the sheets 3B start moving.

According to this embodiment, the distance sensor 249A or 249B measures the moving amount (moving distance) in the direction of the arrow F or E. On the other hand, in the first embodiment shown in FIG. 5, movement of sheets (sheet end portions) to the absolute position G' in the direction of the arrow D is measured (detected). Hence, in the first embodiment, the movement of the sheets 3B of maximum size can be detected only when they move by a distance Y1. In the third embodiment, however, the movement can be detected when the sheets 3B move by only a distance Y2 (FIG. 13). This shortens the detection time. It is therefore possible to disable the detection sensors 40A and 40B in a short time after the sheets 3B start moving.

Note that in the above embodiments, examples in which the sheets 3 are extracted from the first to third extraction portions 38 to 40 have been described. Depending on the installation space of the sheet-fed offset rotary printing press, one of the three extraction portions 38 to 40 may face a wall or the like of the installation place. In such a case, the detection sensors are provided in at least two remaining extraction portions, and the extraction portion facing the wall needs no detection sensors.

In the second and third embodiments, the stacked sheet detection sensor 49 detects the trailing edges of the sheets 3. Instead, the stacked sheet detection sensor 49 may detect the trailing edge of the pallet 15. In the embodiments, the forklift 12 extracts the sheets 3 stacked on the pallet 15. However, a hand lift or the like may extract the sheets 3. In the embodiments, the stacked sheet detection sensor 49, 149, or 249 detects the movement of the sheets 3A or 3B. Otherwise, the control device 50 may determine the movement of the sheets 3A or 3B based on the outputs from the distance sensors 49A and 49B, 149A and 149B, or 249A and 249B.

What is claimed is:

1. A sheet stacking apparatus comprising:

a sheet stacking unit which stacks sheets conveyed by a sheet conveyance device;

three sheet extraction portions which allow to selectively extract the sheets stacked on said sheet stacking unit from one of three directions including a downstream side of a sheet conveyance direction and two directions perpendicular to the sheet conveyance direction;

a plurality of first detection sensors which are provided in at least two of said three sheet extraction portions to detect an object that enters said sheet stacking unit;

a second detection sensor which detects a moving direction of the sheets stacked on said sheet stacking unit; and a control device which stops an operation of the sheet conveyance device when at least one of said plurality of first detection sensors detects the object, and disables a detection operation of at least one of said first detection sensors corresponding to the moving direction of the sheets when said second detection sensor detects the moving direction of the sheets.

2. An apparatus according to claim 1, wherein said first detection sensors are provided in all of said three sheet extraction portions.

3. An apparatus according to claim 1, wherein said second detection sensor is provided on an upstream side of the sheet conveyance direction of said sheet stacking unit.

4. An apparatus according to claim 1, wherein said second detection sensor includes a pair of distance sensors which are arranged at a predetermined interval in a direction perpendicular to the sheet conveyance direction.

5. An apparatus according to claim 4, wherein when said pair of distance sensors detect the sheet and then one of said pair of distance sensors detects the sheets no longer, movement of the sheets in the direction perpendicular to the sheet conveyance direction is detected.

6. An apparatus according to claim 4, wherein when one of said pair of distance sensors detects a predetermined moving amount of the sheets in the direct perpendicular to the sheet conveyance direction, movement of the sheets in the direction perpendicular to the sheet conveyance direction is detected.

7. An apparatus according to claim 4, wherein when both of said pair of distance sensors detect movement of the sheets to a predetermined position on the downstream side of the sheet conveyance direction, movement of the sheets to the downstream side of the sheet conveyance direction is detected.

8. An apparatus according to claim 4, wherein when both of said pair of distance sensors detect separation from the sheets by not less than a predetermined distance on the downstream side of the sheet conveyance direction, movement of the sheets to the downstream side of the sheet conveyance direction is detected.

9. An apparatus according to claim 4, wherein said pair of distance sensors are arranged at an interval smaller than a widthwise length of a sheet of minimum size.

10. An apparatus according to claim 4, wherein said pair of distance sensors are oriented toward the downstream side of the sheet conveyance direction in a direction parallel to the sheet conveyance direction.

11. An apparatus according to claim 4, wherein said pair of distance sensors are arranged toward the downstream side of the sheet conveyance direction while being tilted in directions opposite to each other at the same angle.

* * * * *